US009098044B2

(12) United States Patent
Sakurai

(10) Patent No.: US 9,098,044 B2
(45) Date of Patent: Aug. 4, 2015

(54) IMAGE FORMING SYSTEM, IMAGE FORMING APPARATUS, AND IMAGE FORMING METHOD

(71) Applicant: FUJI XEROX CO., LTD., Tokyo (JP)

(72) Inventor: Tomonari Sakurai, Kanagawa (JP)

(73) Assignee: FUJI XEROX XO., LTD., Tokyo (JP)

( * ) Notice: Subject to any disclaimer, the term of this patent is extended or adjusted under 35 U.S.C. 154(b) by 0 days.

(21) Appl. No.: 14/268,524

(22) Filed: May 2, 2014

(65) Prior Publication Data

US 2015/0098715 A1 Apr. 9, 2015

(30) Foreign Application Priority Data

Oct. 7, 2013 (JP) ..... 2013-210521

(51) Int. Cl.

| | |
|---|---|
| ***G03G 15/00*** | (2006.01) |
| ***G03G 21/00*** | (2006.01) |
| ***B65H 7/06*** | (2006.01) |
| ***B65H 7/20*** | (2006.01) |

(52) U.S. Cl.

CPC ..... *G03G 15/55* (2013.01); *B65H 7/06* (2013.01); *B65H 7/20* (2013.01)

(58) Field of Classification Search

CPC ..... G03G 15/00; G03G 21/00; G03G 21/14; G03G 15/55; B65H 7/06; B65H 7/20

USPC ..... 399/18, 21, 34, 71, 326

See application file for complete search history.

(56) References Cited

U.S. PATENT DOCUMENTS

| | | | | |
|---|---|---|---|---|
| 2008/0044189 | A1* | 2/2008 | Fukui | 399/21 |
| 2008/0175614 | A1 | 7/2008 | Miyazaki | |
| 2011/0135325 | A1* | 6/2011 | Hitaka et al. | 399/21 |
| 2011/0286755 | A1* | 11/2011 | Okano et al. | 399/34 |
| 2012/0106988 | A1* | 5/2012 | Okano | 399/21 |

FOREIGN PATENT DOCUMENTS

| | | | | |
|---|---|---|---|---|
| JP | 05158295 A | * | 6/1993 | G03G 21/00 |
| JP | 2004341080 A | * | 12/2004 | G03G 15/00 |
| JP | 2005059463 A | * | 3/2005 | G03G 15/00 |
| JP | A-2008-176034 | | 7/2008 | |
| JP | 2008185698 A | * | 8/2008 | G03G 21/00 |

* cited by examiner

*Primary Examiner* — Nguyen Ha
(74) *Attorney, Agent, or Firm* — Oliff PLC

(57) ABSTRACT

An image forming system includes a feed section, a transport section, a toner-image forming section, a fixing section, a problem detecting section, and an additional feed section. The feed section feeds a sheet. The transport section transports the sheet fed from the feed section. The toner-image forming section forms a toner image onto the sheet transported by the transport section. The fixing section fixes the toner image formed by the toner-image forming section onto the sheet. The problem detecting section detects a problem in a sheet transport operation. The additional feed section feeds an additional sheet from the feed section toward the fixing section if the number of sheets stopped by the transport section in accordance with detection of the problem by the problem detecting section and subsequently transported toward the fixing section after the sheet transport operation is resumed is smaller than a predetermined number.

7 Claims, 11 Drawing Sheets

IMAGE FORMING SYSTEM, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2013-210521 filed Oct. 7, 2013.

BACKGROUND

Technical Field

The present invention relates to image forming systems, image forming apparatuses, and image forming methods.

SUMMARY

According to an aspect of the invention, there is provided an image forming system including a feed section, a transport section, a toner-image forming section, a fixing section, a problem detecting section, and an additional feed section. The feed section feeds a sheet. The transport section transports the sheet fed from the feed section. The toner-image forming section forms a toner image onto the sheet transported by the transport section. The fixing section fixes the toner image formed by the toner-image forming section onto the sheet. The problem detecting section detects a problem in a sheet transport operation. The additional feed section feeds an additional sheet from the feed section toward the fixing section if the number of sheets stopped by the transport section in accordance with detection of the problem by the problem detecting section and subsequently transported toward the fixing section after the sheet transport operation is resumed is smaller than a predetermined number.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail below with reference to the appended drawings.

Figure 1:
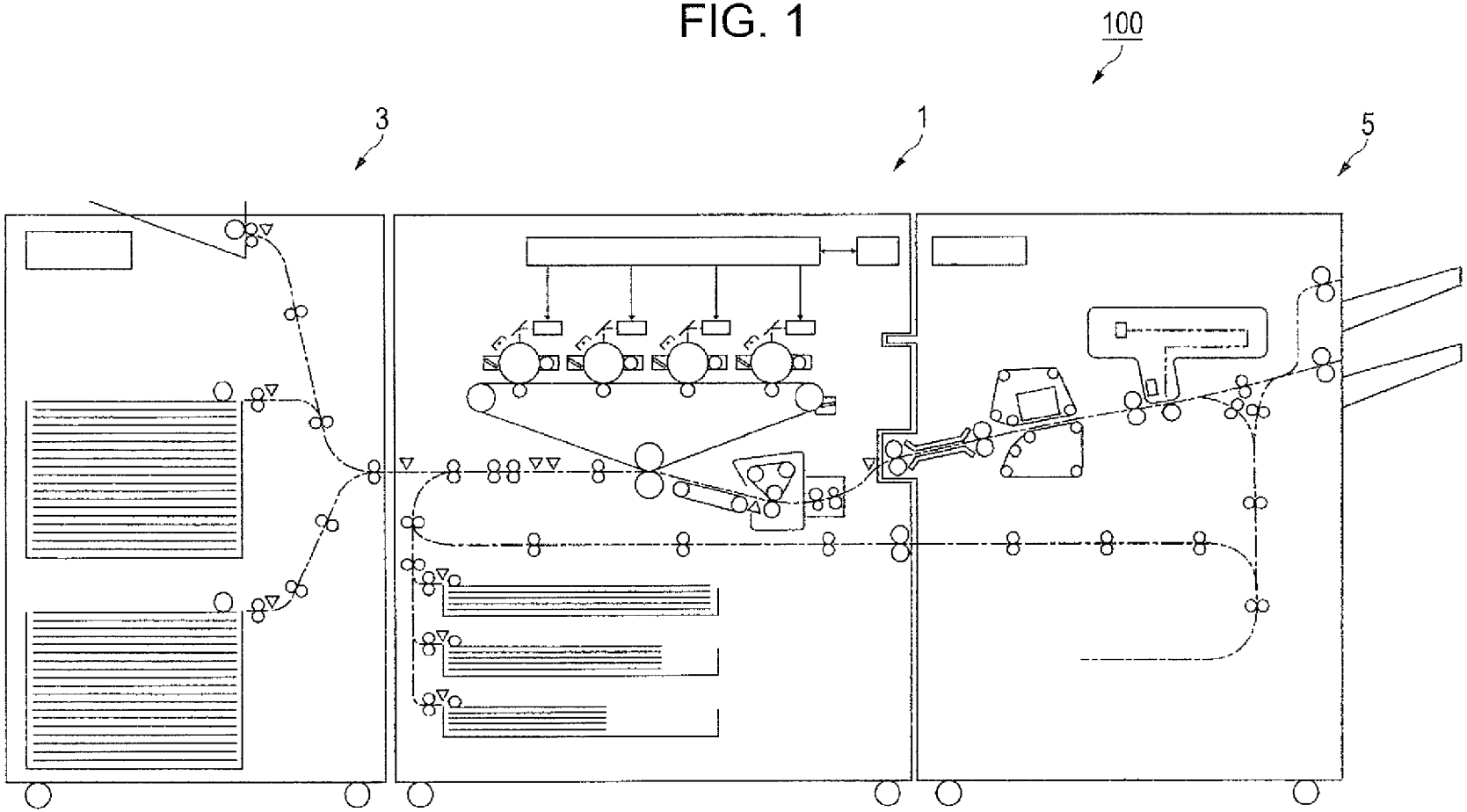
FIG. 1 illustrates the overall configuration of an image forming system to which an exemplary embodiment is applied.

FIG. 1 illustrates the overall configuration of an image forming system 100 to which the exemplary embodiment is applied.

The image forming system 100 shown in FIG. 1 includes an image forming apparatus 1 that forms a color toner image onto a sheet P by, for example, electrophotography, a sheet feed apparatus 3 that holds a large number of sheets P and feeds the sheets P in a one-by-one manner to the image forming apparatus 1, and a sheet processing apparatus 5 that performs a predetermined process on the sheet P having the toner image formed thereon by the image forming apparatus 1.

Although the image forming apparatus 1 that forms an image by electrophotography is described as an example in this exemplary embodiment, the image forming apparatus 1 may alternatively be, for example, an inkjet printer.

Furthermore, although the sheet processing apparatus 5 that performs, for example, cooling on a sheet P is described as an example, the sheet processing apparatus 5 may include a binding device that performs a binding process on a stack of sheets P having images formed thereon or a punching device that performs a hole-punching process, so long as the apparatus is configured to perform a predetermined process on a sheet P having an image formed thereon.

The image forming apparatus 1 may be used alone as the image forming system 100. However, in this exemplary embodiment, the sheet feed apparatus 3 and the sheet processing apparatus 5 are connected as additional apparatuses (so-called optional apparatuses) to the image forming apparatus 1. Furthermore, although the sheet feed apparatus 3 and the sheet processing apparatus 5 are both connected to the image forming apparatus 1 as an example shown in FIG. 1, only one of the sheet feed apparatus 3 and the sheet processing apparatus 5 may be connected to the image forming apparatus 1. Moreover, the image forming apparatus 1 may be connected to an apparatus other than the sheet feed apparatus 3 and the sheet processing apparatus 5.

Image Forming Apparatus 1

Figure 2:
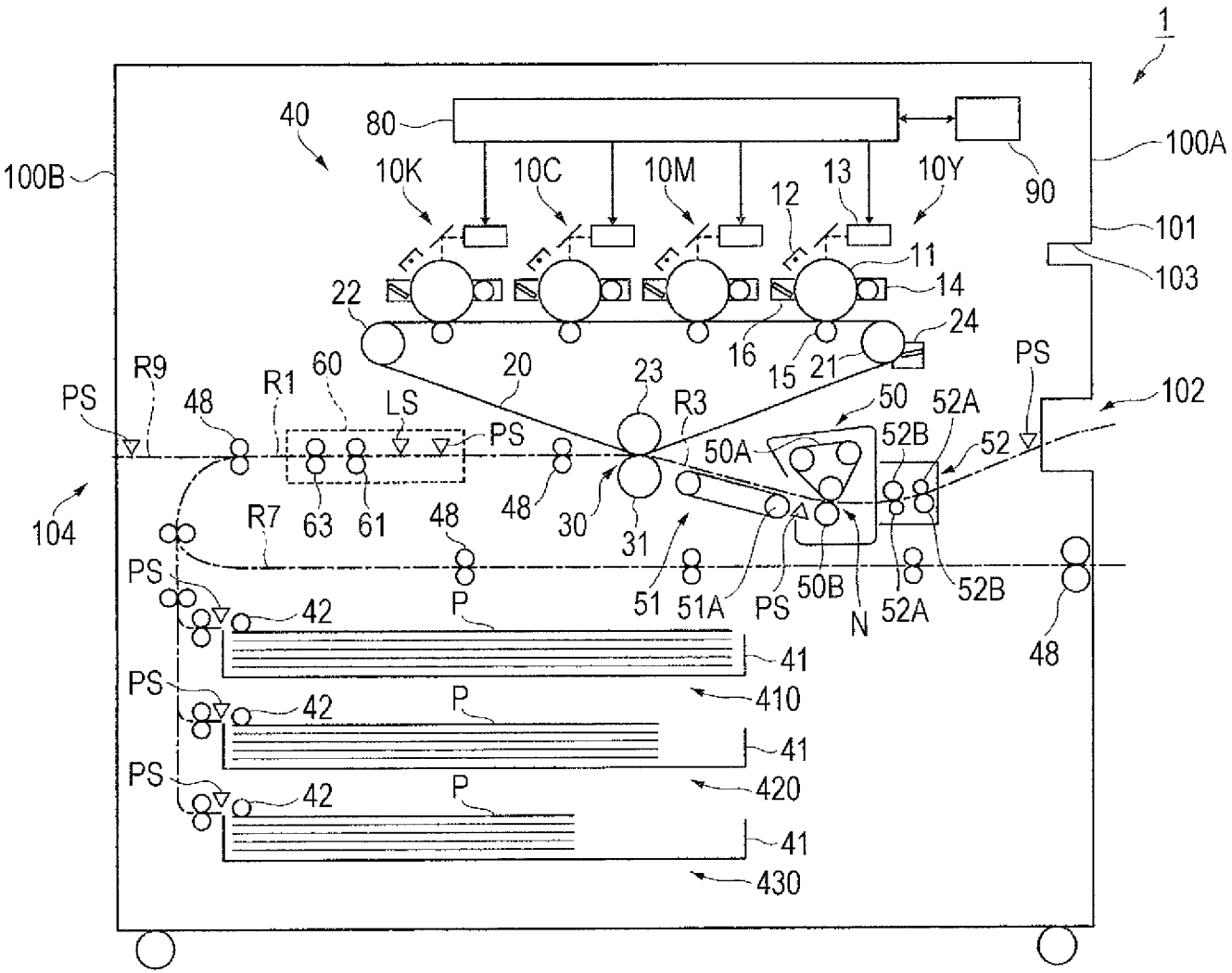
FIG. 2 illustrates the overall configuration of an image forming apparatus.

The image forming apparatus 1 will now be described with reference to FIG. 2. FIG. 2 illustrates the overall configuration of the image forming apparatus 1.

The image forming apparatus 1 shown in FIG. 2 has a so-called tandem-type configuration and includes multiple image forming units 10 (10Y, 10M, 10C, and 10K) that form toner images of different color components by electrophotography. The image forming apparatus 1 is provided with an integrated controller 80 (which will be described later) that receives a print command or image data for image formation from, for example, a personal computer (PC, not shown) connected to the image forming apparatus 1 via a network and that controls the operation of each device and each section constituting the image forming apparatus 1. The image forming apparatus 1 is also provided with a user interface (UI) 90 that is constituted of a display panel. The UI 90 outputs a command received from a user to the integrated controller 80 and provides information from the integrated controller 80 to the user.

The image forming apparatus 1 further includes an intermediate transfer belt 20 onto which the toner images of the different color components formed at the respective image forming units 10 are sequentially transferred (first-transferred) and that bears the toner images, and a second-transfer device 30 that collectively transfers (second-transfers) the toner images on the intermediate transfer belt 20 onto a sheet P. The image forming units 10, the intermediate transfer belt 20, and the second-transfer device 30 may be considered as an image forming section 40. Moreover, the image forming units 10 may be considered as a toner-image forming section.

The image forming apparatus 1 is provided with a first sheet transport path R1 used for transporting a sheet P toward the second-transfer device 30; a second sheet transport path R3 used for transporting the sheet P that has passed through the second-transfer device 30; a third sheet transport path R7 that extends from an end surface 100A, which faces the sheet processing apparatus 5, and connects to the first sheet transport path R1; and a fourth sheet transport path R9 that extends from an end surface 100B, which faces the sheet feed apparatus 3, and connects to the first sheet transport path R1.

Moreover, the image forming apparatus 1 is provided with a position adjuster 60 that adjusts the position of a sheet P transported toward the second-transfer device 30 along the first sheet transport path R1. The first sheet transport path R1, the second sheet transport path R3, and the third sheet transport path R7 are provided with multiple transport rollers 48 as an example of a transport section that transports a sheet P.

The end surface 100A of a housing 101 is provided with an opening 102, and the end surface 100E of the housing 101 is provided with an opening 104. A sheet P transported along the second sheet transport path R3 is discharged outside the housing 101 via the opening 102. A sheet P transported from the sheet feed apparatus 3 is received into the housing 101 via the opening 104. In the housing 101, the end surface 100A provided with the opening 102 has a positioning hole 103. Furthermore, in the example shown in FIG. 2, passing sensors PS that detect passing of a sheet P are provided in the third sheet transport path R7 near the opening 102 and also in the fourth sheet transport path R9 near the opening 104.

Furthermore, the image forming apparatus 1 is provided with a first sheet feed device 410, a second sheet feed device 420, and a third sheet feed device 430 that feed sheets P to the first sheet transport path R1. The first sheet feed device 410 to the third sheet feed device 430 have the same configuration. Each of the first sheet feed device 410 to the third sheet feed device 430 is provided with a sheet accommodation section 41 that accommodates sheets P, a fetching roller 42 that is provided above the sheet accommodation section 41 and at the downstream side thereof in the transport direction of a sheet P (i.e., at the left side of the sheet accommodation section 41 in FIG. 2) and that fetches and transports a sheet P from the sheet accommodation section 41, and a passing sensor PS that detects passing of a sheet P.

The second sheet transport path R3 is provided with a fixing device 50 as an example of a fixing section that fixes an image second-transferred on a sheet P by the second-transfer device 30 onto the sheet P. The fixing device 50 is provided with a heating belt 50A that is heated by a built-in heater (not shown), a pressing roller 50B that presses the heating belt 50A, and a passing sensor PS that detects passing of the sheet P. When the sheet P passes through a nip N where the heating belt 50A and the pressing roller 50B press against each other, the sheet P is pressed and heated, whereby the image on the sheet P becomes fixed onto the sheet P.

A transport device 51 that transports the sheet P that has passed through the second-transfer device 30 toward the fixing device 50 is provided between the second-transfer device 30 and the fixing device 50. The transport device 51 has a rotatable belt 51A and transports the sheet P while supporting the sheet P on this belt 51A.

A curl correcting device 52 that corrects bending (i.e., curling) of the sheet P having the image fixed thereon by the fixing device 50 is provided in the second sheet transport path R3. The curl correcting device 52 has two pairs of rollers in the second sheet transport path R3. Each pair includes a rigid roller 52A and an elastic roller 52B that drives the sheet P while pressing against the rigid roller 52A. With regard to the positional relationship between the two pairs of rigid rollers 52A and elastic rollers 52B disposed with the second sheet transport path R3 interposed therebetween, the two rollers in one pair and the two rollers in the other pair are disposed in an inverted configuration relative to the second sheet transport path R3.

Each of the image forming units 10 includes a rotatably-attached photoconductor drum 11. Each photoconductor drum 11 is surrounded by a charging device 12 that electrostatically charges the photoconductor drum 11, an exposure device 13 that exposes the photoconductor drum 11 to light so as to write an electrostatic latent image thereon, and a developing device 14 that develops the electrostatic latent image on the photoconductor drum 11 into a visible image by using toner. Moreover, each photoconductor drum 11 is provided with a first-transfer device 15 that transfers the toner image of the corresponding color component formed on the photoconductor drum 11 onto the intermediate transfer belt 20, and a drum cleaning device 16 that removes residual toner from the photoconductor drum 11.

The intermediate transfer belt 20 is wrapped around three rollers 21 to 23 and is provided in a rotatable manner. Of these three rollers 21 to 23, the roller 22 is configured to drive the intermediate transfer belt 20. The roller 23 is disposed facing a second-transfer roller 31, which is located below the intermediate transfer belt 20, with the intermediate transfer belt 20 interposed therebetween. The second-transfer roller 31 and the roller 23 constitute the second-transfer device 30. A belt cleaning device 24 that removes residual toner from the intermediate transfer belt 20 is provided at a position where the belt cleaning device 24 faces the roller 21 with the intermediate transfer belt 20 interposed therebetween.

The position adjuster 60 includes a registration roller 61 that transports a sheet P to the second-transfer device 30 in accordance with a moving timing of the intermediate transfer belt 20 having a toner image formed thereon, a pre-registration roller 63 that is located upstream of the registration roller 61 in the first sheet transport path R1 and that transports the sheet P toward the registration roller 61, a line sensor LS that is located downstream of the registration roller 61 in the first sheet transport path R1 and that detects an edge of the sheet P in a direction intersecting the transport direction thereof, and a passing sensor PS that is located downstream of the registration roller 61 in the first sheet transport path R1 and that detects a downstream edge (i.e., leading edge) of the sheet P in the transport direction.

In the position adjuster 60, the leading edge of the sheet P transported by the pre-registration roller 63 abuts on the registration roller 61, which is in a stationary state, so that a skew of the sheet P is corrected. Furthermore, the registration roller 61 that starts to rotate after the skew correcting process nips the sheet P and moves in the direction intersecting the transport direction based on a detection result of the line sensor LS so as to adjust the position of the sheet P in the direction intersecting the transport direction.

Then, the registration roller 61 transports the sheet P toward the second-transfer device 30 in accordance with the moving timing of the intermediate transfer belt 20 having a toner image formed thereon.

Sheet Feed Apparatus 3

Figure 3:
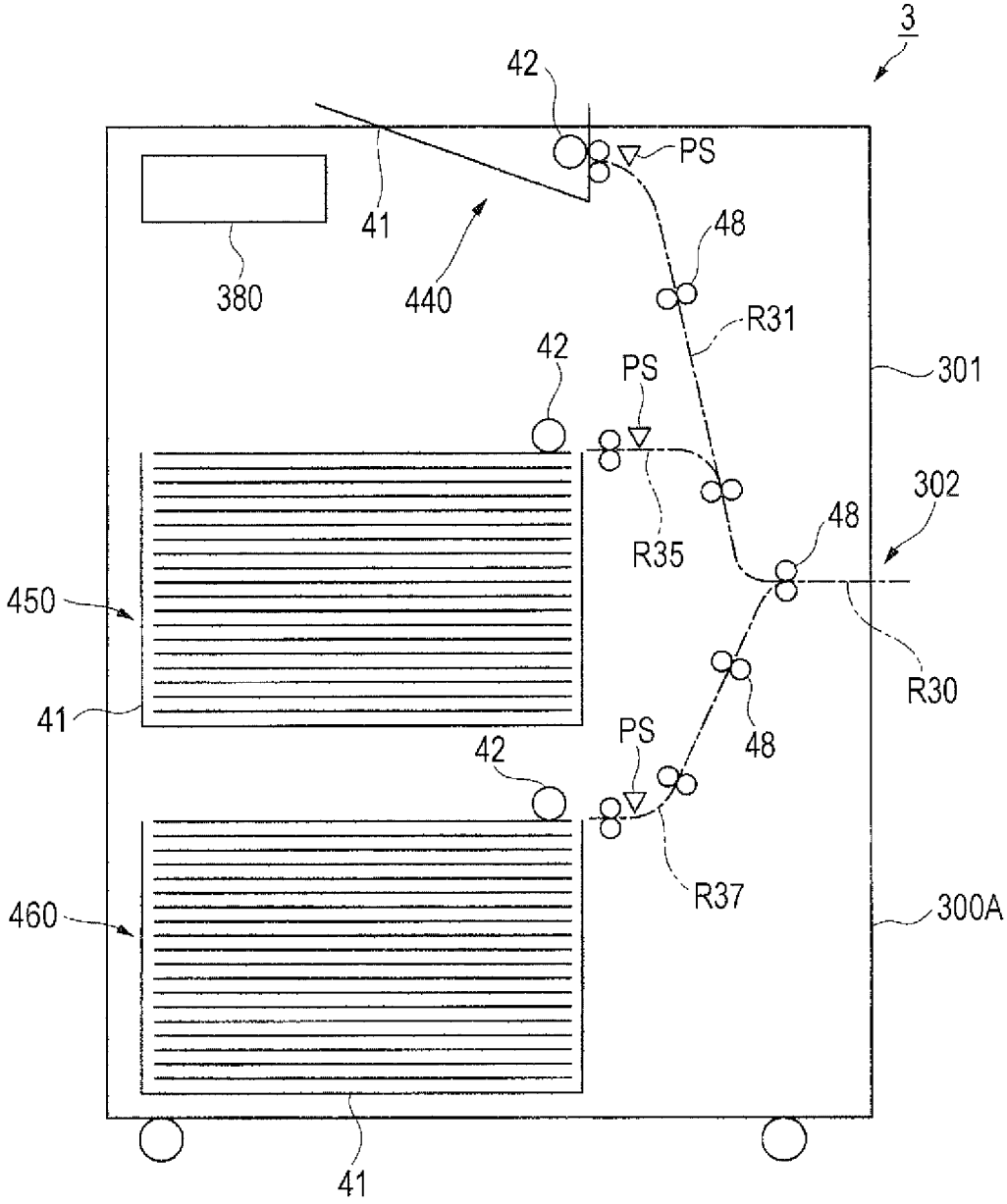
FIG. 3 illustrates the overall configuration of a sheet feed apparatus.

The sheet feed apparatus 3 will now be described with reference to FIG. 3. FIG. 3 illustrates the overall configuration of the sheet feed apparatus 3.

The sheet feed apparatus 3 shown in FIG. 3 is a so-called high-capacity feeder (HCF) and is capable of feeding a sheet P toward the image forming apparatus 1 at high speed. The sheet feed apparatus 3 is used as a so-called optional apparatus when performing an image forming operation on, for example, coated paper or thick paper so that the frequency of resupplying sheets P may be reduced.

The sheet feed apparatus 3 is provided with a first sheet feed path R30 used for transporting a sheet P toward the image forming apparatus 1, and a second sheet feed path R31, a third sheet feed path R35, and a fourth sheet feed path R37 that are connected to the first sheet feed path R30. The first sheet feed path R30 to the fourth sheet feed path R37 are provided with multiple transport rollers 48 that transport a sheet P.

Furthermore, the sheet feed apparatus 3 is provided with a feed controller 380 that is connected to the integrated controller 80 and that controls the operation of each device and each section constituting the sheet feed apparatus 3.

Moreover, the sheet feed apparatus 3 includes a housing 301. An end surface 300A of this housing 301 is provided with an opening 302. A sheet P transported along the first sheet feed path R30 is discharged toward the image forming apparatus 1 via the opening 302.

The sheet feed apparatus 3 is provided with a fourth sheet feed device 440, a fifth sheet feed device 450, and a sixth sheet feed device 460 that feed sheets P to the second sheet feed path R31, the third sheet feed path R35, and the fourth sheet feed path R37, respectively. Each of the fourth sheet feed device 440 to the sixth sheet feed device 460 is provided with a sheet accommodation section 41 that accommodates sheets P, a fetching roller 42 that is provided above the sheet accommodation section 41 and at the downstream thereof in the transport direction of a sheet P (i.e., at the right side of the sheet accommodation section 41 in FIG. 3) and that fetches and transports a sheet P from the sheet accommodation section 41, and a passing sensor PS that detects passing of a sheet P.

In the example shown in FIG. 3, the sheet accommodation section 41 of the fourth sheet feed device 440 has an inclined section on which a sheet P is loaded. The sheet accommodation sections 41 of the fifth sheet feed device 450 and the sixth sheet feed device 460 each have a housing that accommodates sheets P therein. Alternatively, the sheet accommodation sections 41 may have different configurations.

Sheet Processing Apparatus 5

Figure 4:
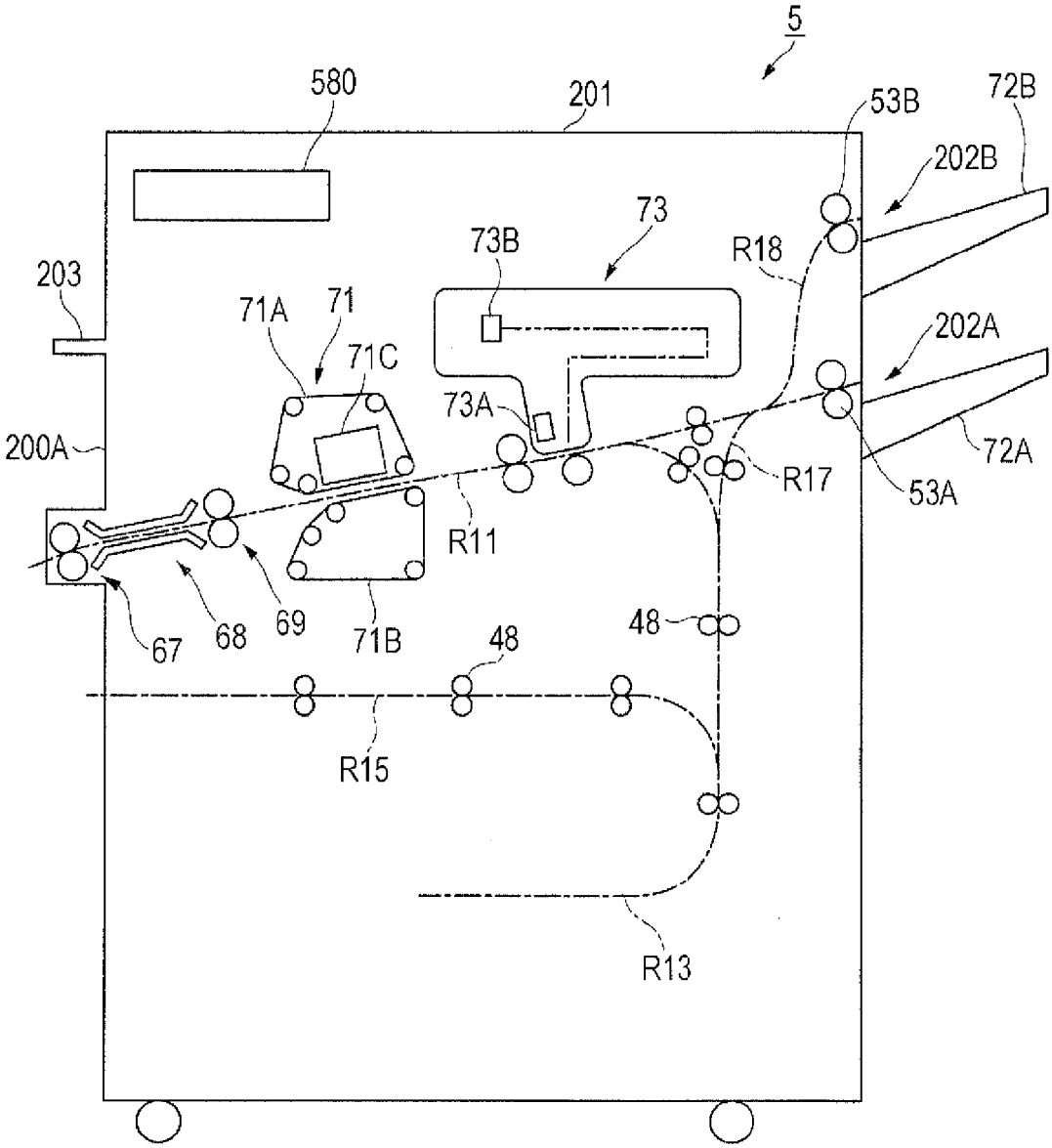
FIG. 4 illustrates the overall configuration of a sheet processing apparatus.

The sheet processing apparatus 5 will now be described with reference to FIG. 4. FIG. 4 illustrates the overall configuration of the sheet processing apparatus 5.

The sheet processing apparatus 5 is provided with a receiving roller 67 that receives a sheet P having an image fixed thereon by the fixing device 50 of the image forming apparatus 1, a movable transport roller 69 that further transports the sheet P received by the receiving roller 67, and a guide member (i.e., a so-called chute) 68 that is provided between the receiving roller 67 and the movable transport roller 69. The guide member 68 forms a part of a fifth sheet transport path R11 and guides the sheet P that has passed through the receiving roller 67 toward the movable transport roller 69.

The sheet processing apparatus 5 includes a cooling device 71 that cools the aforementioned toner images of the respective colors on the sheet P and facilitates the fixation of the toner images onto the sheet P, an in-line sensor 73 that optically detects, for example, density defects, image defects, and image-position defects in the toner images fixed on the sheet P, a first discharge roller 53A and a second discharge roller 53B that discharge the sheet P that has passed through the in-line sensor 73 outward from the sheet processing apparatus 5, a first sheet load section 72A onto which the sheet P discharged by the first discharge roller 53A is loaded, a second sheet load section 72B onto which the sheet P discharged by the second discharge roller 53B is loaded, and a processing controller 580 that is connected to the integrated controller 80 and controls the operation of each device and each section constituting the sheet processing apparatus 5.

The sheet processing apparatus 5 is provided with the fifth sheet transport path R11 used for transporting a sheet P discharged from the image forming apparatus 1 to the first sheet load section 72A, an inversion transport path R13 that branches off from the fifth sheet transport path R11 at the downstream side of the in-line sensor 73, a re-transport path R15 that branches off from the inversion transport path R13 and connects to the third sheet transport path R7 in the image forming apparatus 1, a sixth sheet transport path R17 that branches off from the inversion transport path R13 and connects to the fifth sheet transport path R11, and a seventh sheet transport path R18 that branches off from the fifth sheet transport path R11 and is used for transporting a sheet P toward the second sheet load section 72B.

The fifth sheet transport path R11, the inversion transport path R13, the re-transport path R15, the sixth sheet transport path R17, and the seventh sheet transport path R18 are provided with multiple transport rollers 48 that transport a sheet P.

The sheet processing apparatus 5 includes a housing 201 having a first opening 202A and a second opening 202B. A sheet P transported along the fifth sheet transport path R11 is either discharged from the first opening 202A by the first discharge roller 53A so as to be loaded onto the first sheet load section 72A, or discharged from the second opening 202B by the second discharge roller 53B so as to be loaded onto the second sheet load section 72B.

An end surface 200A of the housing 201 that faces the image forming apparatus 1 is provided with a positioning pin 203 at a position corresponding to the positioning hole 103 in the image forming apparatus 1. The positioning pin 203 protrudes outward from the housing 201. When connecting the sheet processing apparatus 5 to the image forming apparatus 1, the positioning pin 203 is inserted into the positioning hole 103 so that the sheet processing apparatus 5 is positionally set relative to the image forming apparatus 1.

The cooling device 71 includes transport belts 71A and 71B that transport a sheet P along the fifth sheet transport path R11 while nipping the sheet P from upper and lower sides thereof, a heat sink 71C that is formed of multiple fins and cools the transport belts 71A and 71B by receiving air sent from an externally-provided fan (not shown), and multiple tension rollers that rotate the transport belts 71A and 71B while applying tension thereto.

The heat sink 71C is in contact with the inner peripheral surface of the transport belt 71A so as to absorb heat from the transport belt 71A. Thus, the sheet P heated by the fixing device 50 is cooled, whereby the toner on the surface of the sheet P becomes fixed thereon while its smoothness is maintained.

The in-line sensor 73 includes a light source 73A formed of, for example, an incandescent lamp or a white-light emitting diode, and a light receiving element 73B formed of, for example, a charge coupled device (CCD).

The light receiving element 73B receives light radiated from the light source 73A and reflected by a sheet P traveling along the fifth sheet transport path R11. Based on the intensity of the received light, the light receiving element 73B outputs a signal to the integrated controller 80 of the image forming apparatus 1. Based on the signal from the in-line sensor 73, the integrated controller 80 corrects images to be formed at the image forming units 10. For example, the intensity of light radiated by the exposure devices 13 or an image formation position is corrected based on the signal from the in-line sensor 73.

In the sheet processing apparatus 5 according to this exemplary embodiment, a sheet P having an image formed on one face thereof may be switched back by the inversion transport path R13, where appropriate. Then, the switched-back sheet P whose leading edge and trailing edge in the transport direction thereof have been switched is transported toward the sixth sheet transport path R17 or the re-transport path R15.

In a case where the sheet P is transported from the inversion transport path R13 toward the sixth sheet transport path R17, the sheet P, in an inverted state, is transported along the sixth sheet transport path R17 and the fifth sheet transport path R11 so as to be discharged outside the sheet processing apparatus 5.

On the other hand, in a case where the sheet P is transported from the inversion transport path R13 toward the re-transport path R15, the sheet P, in an inverted state, is transported again to the second-transfer device 30 via the third sheet transport path R7 and the first sheet transport path R1. Thus, an image is formed on the other face of the inverted sheet P at the second-transfer device 30. In other words, images are formed on both faces of the sheet P. The inversion transport path R13 may be considered as a switch-back path or a duplex printing path.

Operation of Image Forming System 100

Next, an image forming operation performed by the image forming system 100 according to this exemplary embodiment will be described with reference to FIGS. 1 to 4.

The first sheet feed path R30 in the sheet feed apparatus 3 in the image forming system 100 is connected to the fourth sheet transport path R9 in the image forming apparatus 1, the second sheet transport path R3 in the image forming apparatus 1 is connected to the fifth sheet transport path R11, and the third sheet transport path R7 in the image forming apparatus 1 is connected to the re-transport path R15.

When image data created by the PC (not shown) is received by the integrated controller 80 of the image forming apparatus 1, the integrated controller 80 performs image processing on the image data. The image-processed image data is output to the exposure devices 13. Each exposure device 13 receiving the image data selectively exposes the corresponding photoconductor drum 11 electrostatically charged by the corresponding charging device 12 to light, thereby forming an electrostatic latent image on the photoconductor drum 11. The electrostatic latent image formed on the photoconductor drum 11 is developed into, for example, a black (K) toner image by the corresponding developing device 14.

In accordance with an image formation timing, a sheet P is fed to the first sheet transport path R1 from any one of the first sheet feed device 410 to the sixth sheet feed device 460 serving as an example of a feed section. This sheet P is transported toward the second-transfer device 30 in accordance with a rotation timing of the intermediate transfer belt 20. At the second-transfer device 30, the toner image formed on the photoconductor drum 11 is transferred onto the sheet P.

Subsequently, the sheet P having the toner image transferred thereon is transported along the second sheet transport path R3 and undergoes a fixing process at the fixing device 50. Then, the sheet P having the fixed image thereon undergoes a curl correction process at the curl correcting device 52. Subsequently, the sheet P that has passed through the curl correcting device 52 is discharged from the opening 102 provided in the housing 101.

The sheet P discharged from the opening 102 in the image forming apparatus 1 is cooled by the cooling device 71 while being transported along the fifth sheet transport path R11 in the sheet processing apparatus 5, and the in-line sensor 73 detects the toner image. Then, the sheet P is transported along the fifth sheet transport path R11 and is discharged from the first opening 202A in the housing 201 so as to be loaded onto the first sheet load section 72A.

After each image forming unit 10 performs the image forming process and the toner image on the photoconductor drum 11 is transferred onto the sheet P, residual toner is sometimes adhered on the photoconductor drum 11. The residual toner on the photoconductor drum 11 is removed therefrom by the drum cleaning device 16. Likewise, residual toner on the intermediate transfer belt 20 is removed therefrom by the belt cleaning device 24.

When duplex printing is to be performed, the sheet P that has the fixed image formed on one face of the sheet P as a result of the above-described process and that has passed through the in-line sensor 73 is guided toward the inversion transport path R13 from the fifth sheet transport path R11. Then, the sheet P switched back by the inversion transport path R13 is transported again to the second-transfer device 30 via the re-transport path R15, the third sheet transport path R7, and the first sheet transport path R1.

The sheet P having a toner image formed on the other face thereof passes through the second-transfer device 30 and the curl correcting device 52 again. Then, the sheet P is discharged from the opening 102. The sheet P discharged from the opening 102 of the image forming apparatus 1 is transported along the fifth sheet transport path R11 in the sheet processing apparatus 5 and is loaded onto the first sheet load section 72A via the cooling device 71, the in-line sensor 73, and the first opening 202A.

Contamination of Fixing Device 50 Due to Unfixed Toner

When the image forming system 100 operates in the above-described manner, a so-called jam in which the transported sheet P becomes jammed in the transport path may sometimes occur. When such a jam occurs, the image forming system 100 temporarily stops the sheet transport operation and the image forming operation and subsequently performs a recovery operation for resuming the image forming operation.

Depending on, for example, the timing at which the jam occurs, the sheet P having the toner image formed thereon may be stopped at the fixing device 50 when the sheet transport operation is temporarily stopped. With regard to the sheet P stopped at the fixing device 50, the toner image formed in an area of the sheet P that has not passed through the nip N of the fixing device 50 (i.e., an area upstream of the nip N in the transport direction) has not undergone a fixing process by the fixing device 50 and is thus in an unfixed state.

When, for example, an operator removes this sheet P from the fixing device 50 during the recovery operation, the unfixed toner may adhere to the fixing device 50 and contaminate the fixing device 50. This contamination of the fixing device 50 may lead to problems, such as contaminating a subsequent sheet P when the image forming operation is to be performed thereon upon completion of the recovery operation.

In the recovery operation according to this exemplary embodiment, the fixing device 50 is cleaned after the sheet P stopped at the fixing device 50 is removed. This cleaning operation involves cleaning the fixing device 50 by causing a sheet or sheets P (i.e., remaining sheet or sheets) stopped in the transport path due to the occurrence of the jam to pass through the fixing device 50. If the number of remaining sheets is not sufficient for cleaning the fixing device 50 (i.e., if the number of remaining sheets does not satisfy a predetermined reference number of sheets), the cleaning operation is performed by additionally feeding a new sheet or sheets P (i.e., a fresh sheet or sheets) from any one of the first sheet feed device 410 to the sixth sheet feed device 460. Specifically, in the recovery operation according to this exemplary embodiment, the fixing device 50 is cleaned with a combination of remaining and fresh sheets. The image forming operation is not performed during this cleaning operation.

The configuration for executing the cleaning operation, the outline of the recovery operation, the operation of fixation-sheet processing that partially includes the cleaning operation, and the movement of sheets P during the fixation-sheet processing will be described below in this order.

Integrated Controller 80

Figure 5:
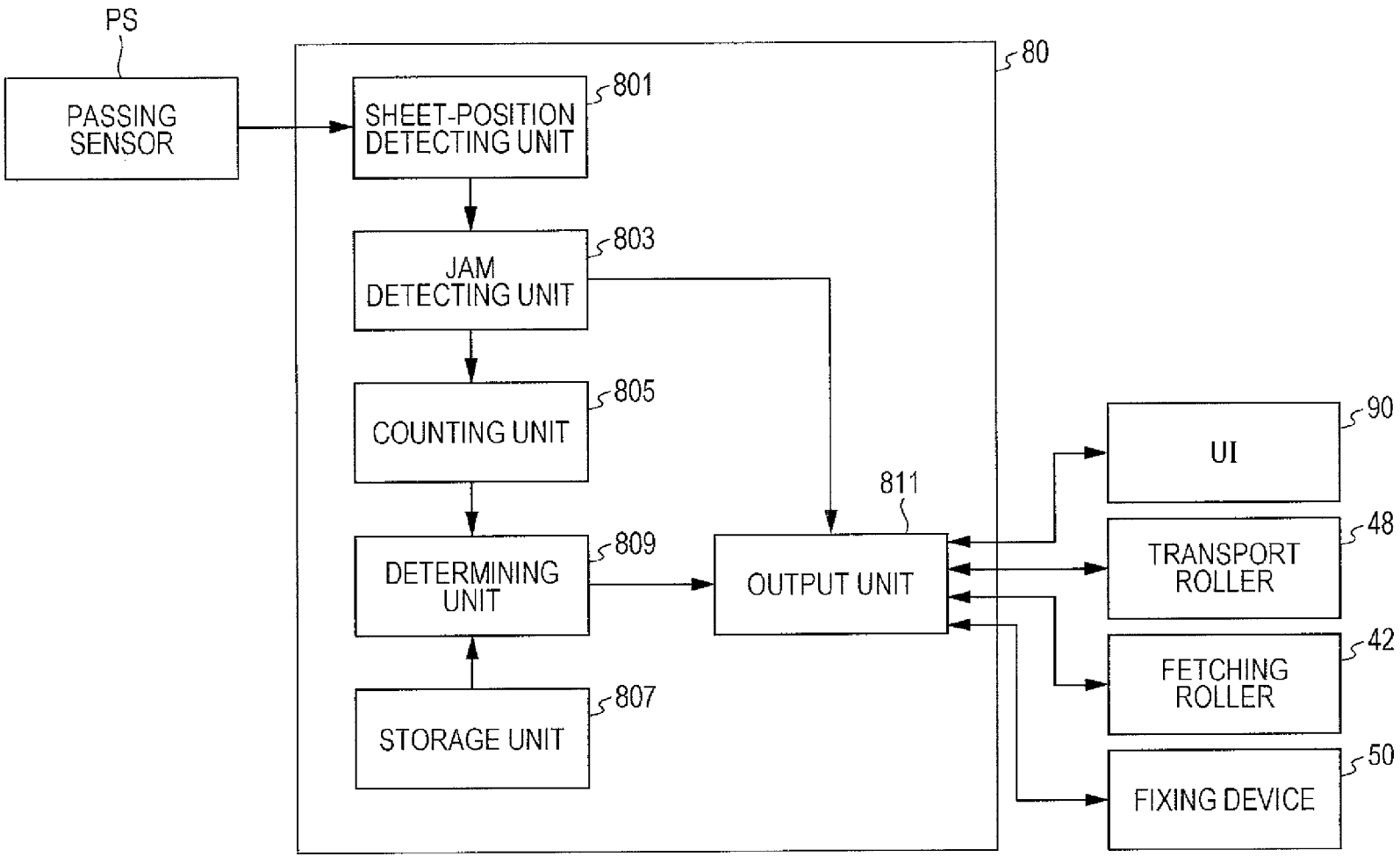
FIG. 5 illustrates a functional configuration of an integrated controller.

The integrated controller 80 will now be described with reference to FIG. 5. FIG. 5 illustrates a functional configuration of the integrated controller 80.

The integrated controller 80, which is an example of a problem detecting section and an additional feed section, is realized by, for example, a processor that achieves its function by being controlled by a program, a nonvolatile memory that stores the program for controlling the processor, and a volatile memory used for, for example, data processing performed by the processor.

The integrated controller 80 includes a sheet-position detecting unit 801 that receives a detection signal from a passing sensor PS and detects the position of a sheet P in a transport path based on this detection signal, a jam detecting unit 803 that detects a jam based on the position of the sheet P detected by the sheet-position detecting unit 801, a counting unit 805 that counts the number of sheets P transported to the fixing device 50 in an up-purging process (which will be described in detail later), a storage unit 807 that stores a reference number of sheets (which will be described in detail later), a determining unit 809 that determines whether or not additional feeding is to be performed based on the number of sheets P counted by the counting unit 805 and the reference number of sheets stored in the storage unit 807, an output unit 811 that outputs control signals to the UI 90, the transport rollers 48, the fetching rollers 42, and the fixing device 50 in accordance with detection of a jam by the jam detecting unit 803 or determination for additional feeding by the determining unit 809.

Recovery Operation

Figure 6:
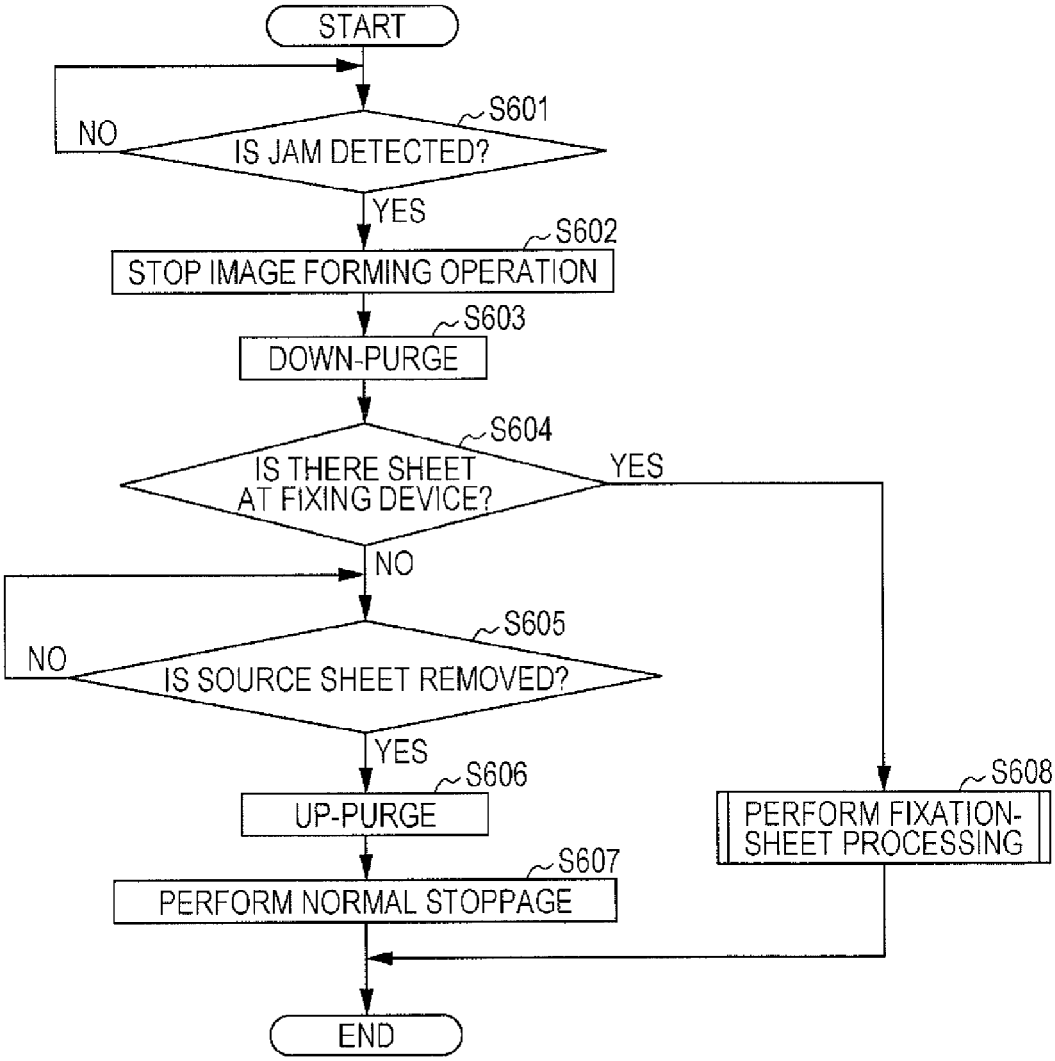
FIG. 6 is a flowchart illustrating a recovery operation.

FIG. 6 is a flowchart illustrating the recovery operation. In the example shown in FIG. 6, the integrated controller 80 monitors the sheet transport status based on detection signals from the passing sensors PS. If the integrated controller 80 detects a jam (YES in step S601), the image forming operation performed by the image forming system 100 is stopped in step S602. With the stoppage of the image forming operation, the heating of the heating belt 50A by the heater (not shown) of the fixing device 50 is also stopped.

In step S603, the sheet transport operation is stopped while a sheet P located downstream, in the sheet transport direction, of the sheet P (referred to as "source sheet" hereinafter) that has caused the jam in the image forming system 100 is discharged (down-purged) toward the second sheet load section 72B. With the stoppage of the image forming operation, a sheet P located upstream of the source sheet is stopped in the transport path and is maintained in the stopped state in the transport path even during the down-purging process.

Then, in step S604, the integrated controller 80 checks whether or not a sheet P is stopped at the fixing device 50 via the passing sensor PS of the fixing device 50, which is an example of a fixation-sheet detecting section. If the sheet P is not stopped at the fixing device 50 (NO in step S604), it is determined in step S605 whether or not the source sheet has been removed by the operator. If the source sheet has been removed (YES in step S605), a remaining sheet or sheets in the sheet transport path is/are discharged (up-purged) onto the second sheet load section 72B in step S606, and the system undergoes normal stoppage in step S607. On the other hand, if a sheet P is stopped at the fixing device 50 (YES in step S604), fixation-sheet processing is performed in step S608.

With the above-described operation, the recovery operation in the image forming system 100 is completed.

As described above, the sheets P discharged by down-purging and up-purging are discharged onto the second sheet load section 72B, which is different from the first sheet load section 72A onto which sheets P having undergone a normal image forming operation are discharged. This makes it easy to differentiate between sheets P having undergone a normal image forming operation and other sheets P.

Fixation-Sheet Processing

Figure 7:
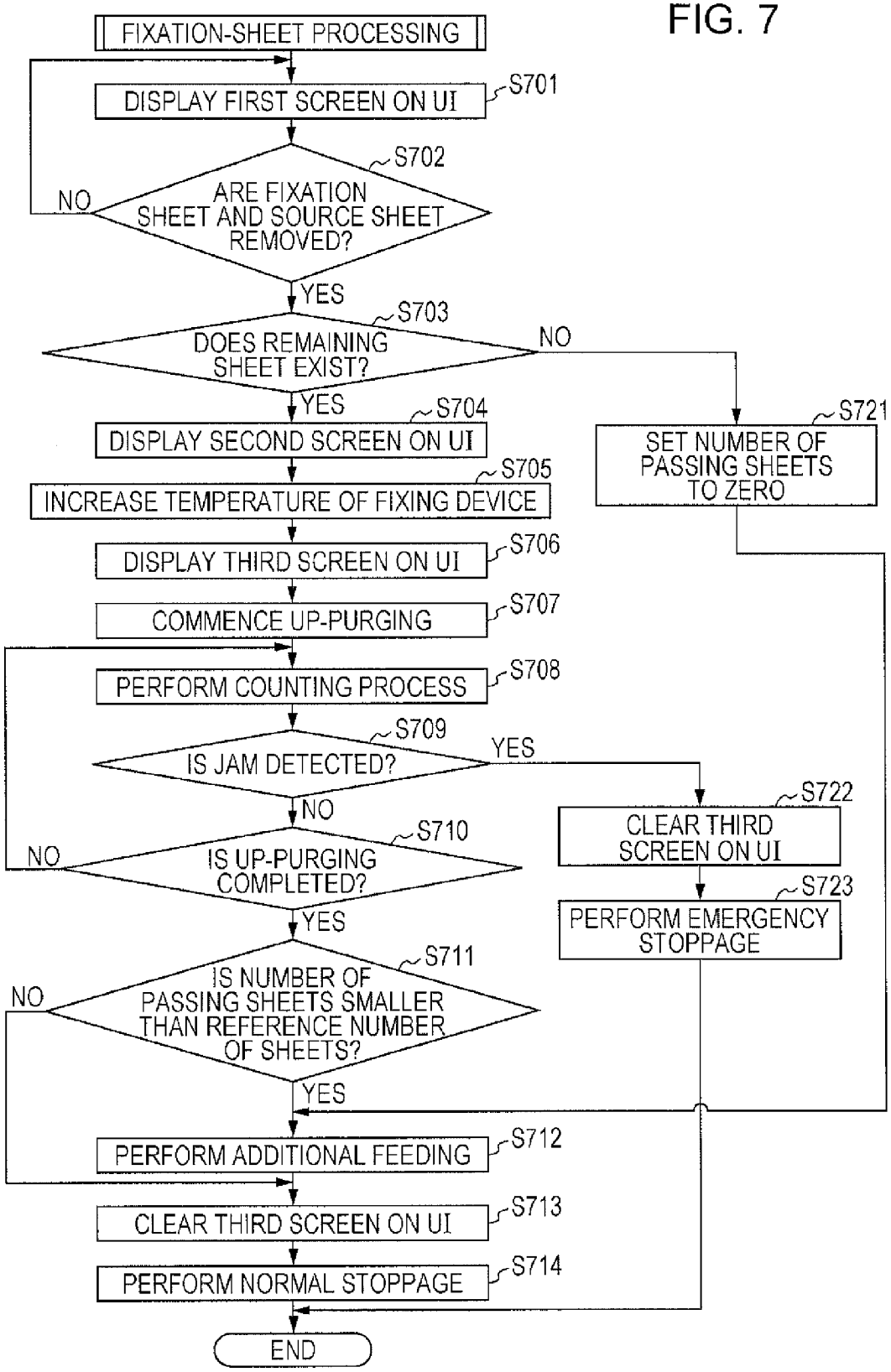
FIG. 7 is a flowchart illustrating the operation of fixation-sheet processing.
Figure 8A:
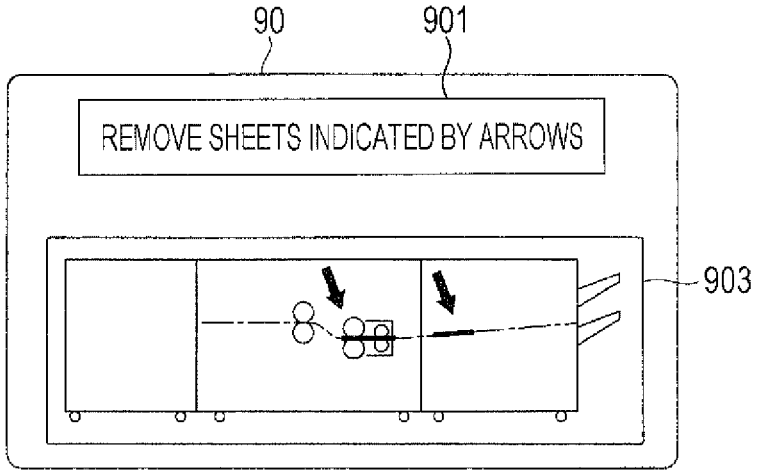
FIG. 8A illustrates a user interface displaying a first screen.
Figure 8B:
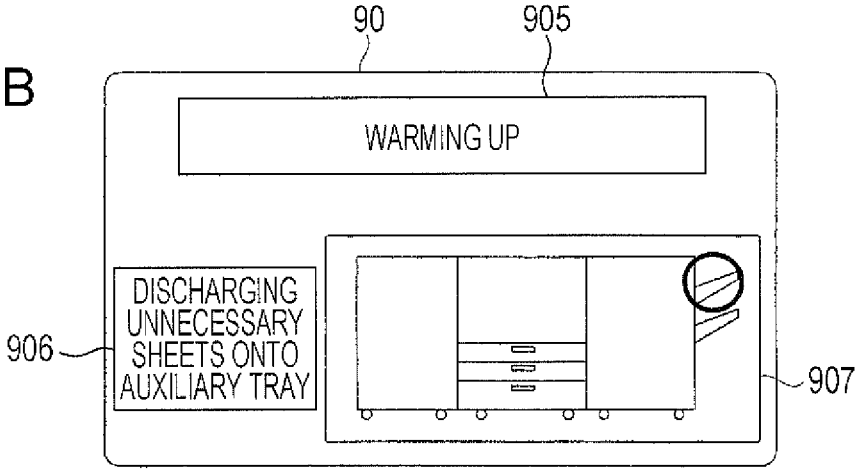
FIG. 8B illustrates the user interface displaying a second screen.
Figure 8C:
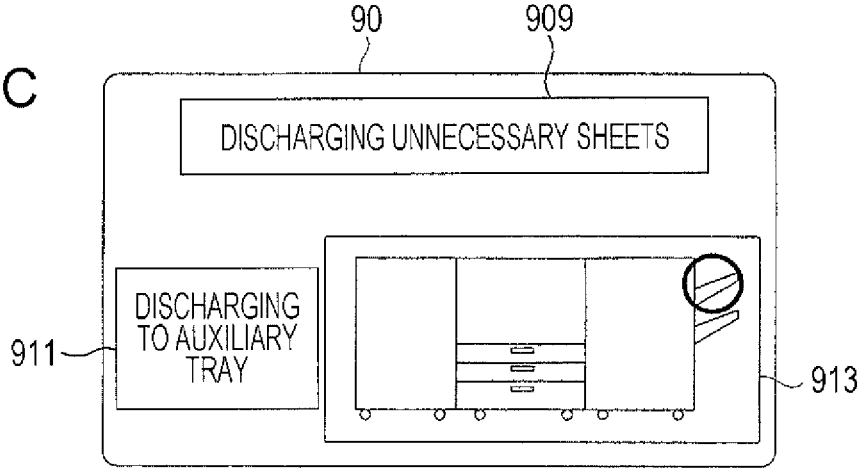
FIG. 8C illustrates the user interface displaying a third screen.

Next, fixation-sheet processing will be described with reference to FIG. 7 and FIGS. 8A to 80. FIG. 7 is a flowchart illustrating the operation of fixation-sheet processing. FIG. 8A illustrates the UI 90 displaying a first screen. FIG. 8B illustrates the UI 90 displaying a second screen. FIG. 8C illustrates the UI 90 displaying a third screen.

In the following description, a sheet P stopped at the fixing device 50 as a result of stoppage of the sheet transport operation due to the occurrence of a jam will be referred to as "fixation sheet", feeding of a new sheet P from any one of the first sheet feed device 410 to the sixth sheet feed device 460 in the fixation-sheet processing will be referred to as "additional feeding", and a sheet P fed by this additional feeding will be referred to as "additionally-fed sheet".

Referring to FIG. 7, in step S701, the integrated controller 80 makes the UI 90 display the first screen. As shown in FIG. 8A, this first screen includes an image 901 prompting the operator to remove the fixation sheet and the source sheet and an image 903 indicating the positions of sheets P to be removed in the image forming system 100.

In step S702, the integrated controller 80 determines whether or not the fixation sheet and the source sheet have been removed by the operator. If the fixation sheet and the source sheet have been removed (YES in step S702), the integrated controller 80 determines in step S703 whether or not a remaining sheet, which is a sheet P that is to be up-purged, exists.

If there is a remaining sheet (YES in step S703), the integrated controller 80 makes the UI 90 display the second screen in step S704. As shown in FIG. 8B, this second screen includes an image 905 indicating that the fixing device 50 is being increased in temperature, an image 906 indicating a preparation message for discharging a sheet P onto the second sheet load section 72B, and an image 907 indicating the position of the second sheet load section 72B, onto which the sheet P is to be discharged, in the image forming system 100.

In step S705, the integrated controller 80 heats the fixing device 50 to a fixation temperature, specifically, heats the heating belt 50A with the heater (not shown) of the fixing device 50. Then, in step S706, the integrated controller 80 makes the UI 90 display the third screen. As shown in FIG. 8C, this third screen includes an image 909 indicating that an unnecessary sheet P (i.e., remaining sheet) is being discharged, an image 911 indicating that the sheet P is discharged onto the second sheet load section 72B, and an image 913 indicating the position of the second sheet load section 72B in the image forming system 100.

In step S707, the integrated controller 80 commences an up-purging process. In step S708, the integrated controller 80 counts the number of passing sheets P transported to the fixing device 50 in this up-purging process via the passing sensor PS of the position adjuster 60. In step S709, the integrated controller 80 monitors the sheet transport status based on a detection signal from the passing sensor PS during this up-purging process. Then, if the sheet transport operation is performed without any detection of a jam (NO in step S709), the integrated controller 80 determines in step S710 whether or not the up-purging process is completed. In this example, the up-purging process is determined as being completed based on whether or not the duration of the up-purging process has exceeded a predetermined time.

In step S711, the integrated controller 80 determines whether or not the number of passing sheets is smaller than the reference number of sheets. If the number of passing sheets is smaller than the reference number of sheets (YES in step S711), additional feeding is performed in step S712. In this case, the number of additionally-fed sheets is equivalent to a difference between the reference number of sheets and the number of passing sheets. After the additional feeding is performed for the number of sheets equivalent to the difference between the reference number of sheets and the number of passing sheets, the integrated controller 80 clears the third screen displayed on the UI 90 in step S713, and the system undergoes normal stoppage in step S714.

On the other hand, if there are no sheets P to be up-purged after the fixation sheet and the source sheet have been removed (NO in step S703), the number of passing sheets is set to zero in step S721, and additional feeding is subsequently performed in step S712. Because the number of additionally-fed sheets is equivalent to the difference between the reference number of sheets and the number of passing sheets, as described above, the number of additionally-fed sheets is equal to the reference number of sheets in this case where the number of passing sheets is zero.

If the integrated controller 80 detects a jam in the up-purging process (YES in step S709), the integrated controller 80 clears the third screen displayed on the UI 90 in step S722, and the system undergoes emergency stoppage in step S723.

Furthermore, if the number of passing sheets is larger than or equal to the reference number of sheets (NO in step S711), the integrated controller 80 clears the third screen in step S713 without performing additional feeding, and the system undergoes normal stoppage in step S714.

Movement of Sheets P During Fixation-Sheet Processing

Next, the movement of sheets P during the fixation-sheet processing will be described with reference to FIGS. 9A to 9E. FIGS. 9A to 9E illustrate the movement of sheets P during the fixation-sheet processing. In the following description, the reference number of sheets is set to four.

Figure 9A:
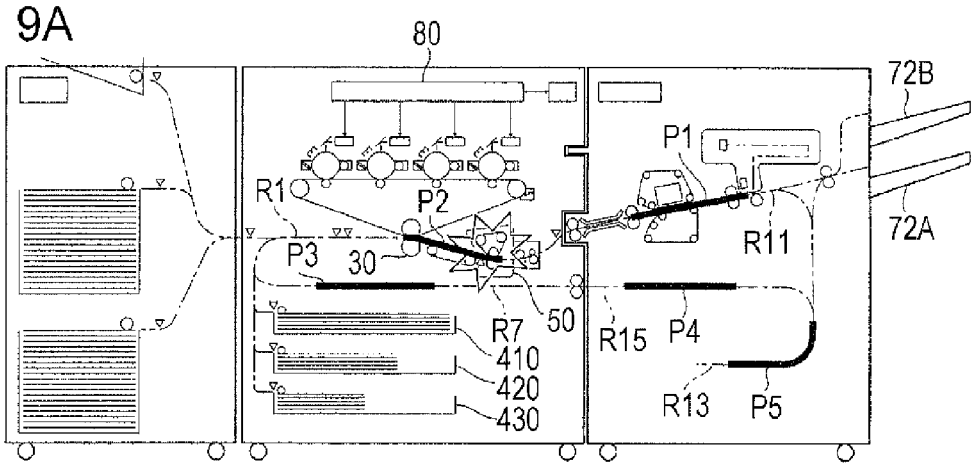
FIGS. 9A to 9E illustrate the movement of sheets during the fixation-sheet processing.

First, in the example shown in FIG. 9A, sheets P1 to P5 are being transported in this order and a duplex-printing job (i.e., a series of image forming operations performed based on a group of image data) is being performed on these sheets P1 to P5. More specifically, the sheet P1 has undergone duplex printing and is located in the fifth sheet transport path R11. The sheet P2 has undergone front-face printing and is undergoing reverse-face printing at the fixing device 50. The sheets P3 to P5 have undergone front-face printing but have not undergone reverse-face printing yet and are respectively located in the third sheet transport path R7, the re-transport path R15, and the inversion transport path R13. In this state, it is assumed that the sheet P2 passing through the fixing device 50 is jammed. In other words, the sheet P2 is the source sheet and the fixation sheet.

Figure 9B:
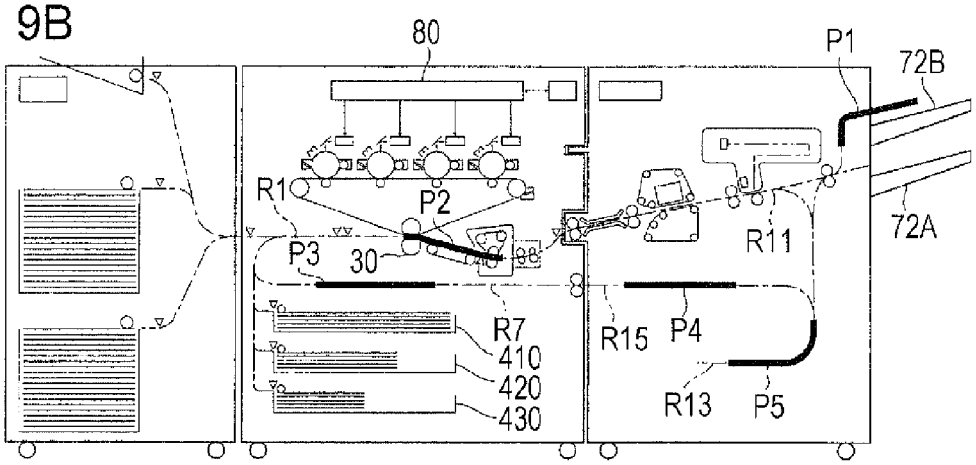
Figure 9C:
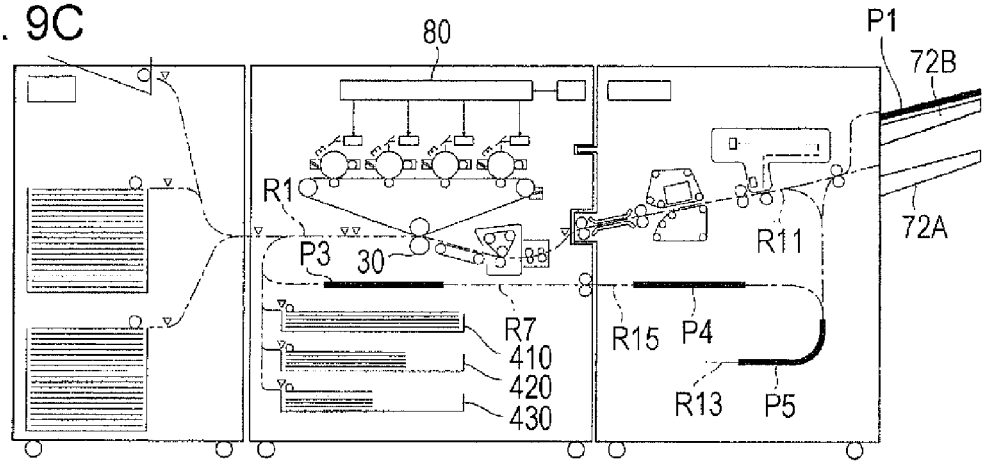

Subsequently, as shown in FIG. 9B, the sheet transport operation is stopped while a down-purging process is performed. Specifically, the sheet P1 located downstream of the sheet P2, which is the source sheet, in the sheet transport direction is discharged onto the second sheet load section 72B due to the down-purging process. On the other hand, the sheets P2 to P5 are stopped in the respective transport paths. Then, as shown in FIG. 9C, the sheet P2, which is the source sheet, is removed by the operator.

Figure 9D:
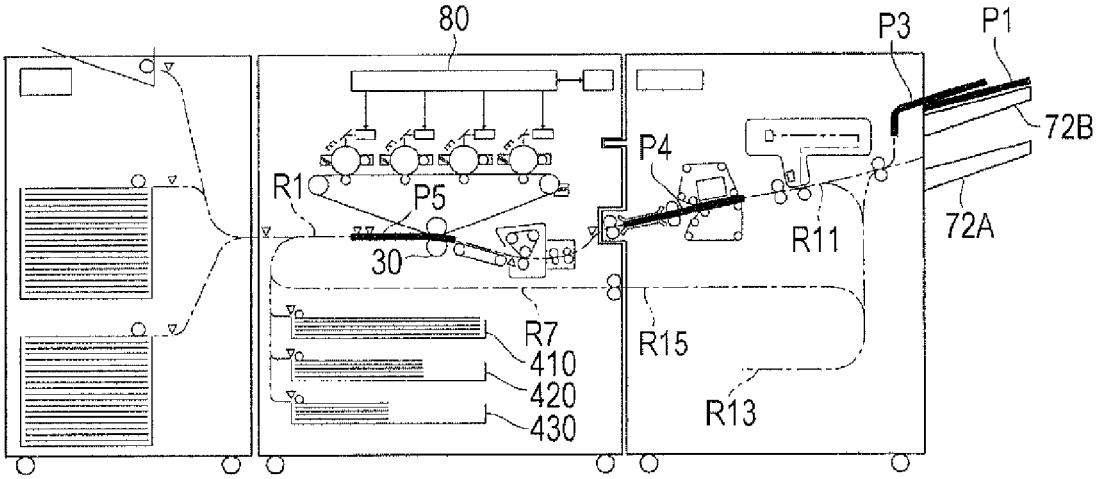

Subsequently, as shown in FIG. 9D, an up-purging process is performed while the number of passing sheets in the fixing device 50 is counted, and the fixing device 50 is cleaned by the sheets P3 to P5. Then, the sheets P3 to P5 are discharged onto the second sheet load section 72B.

Figure 9E:
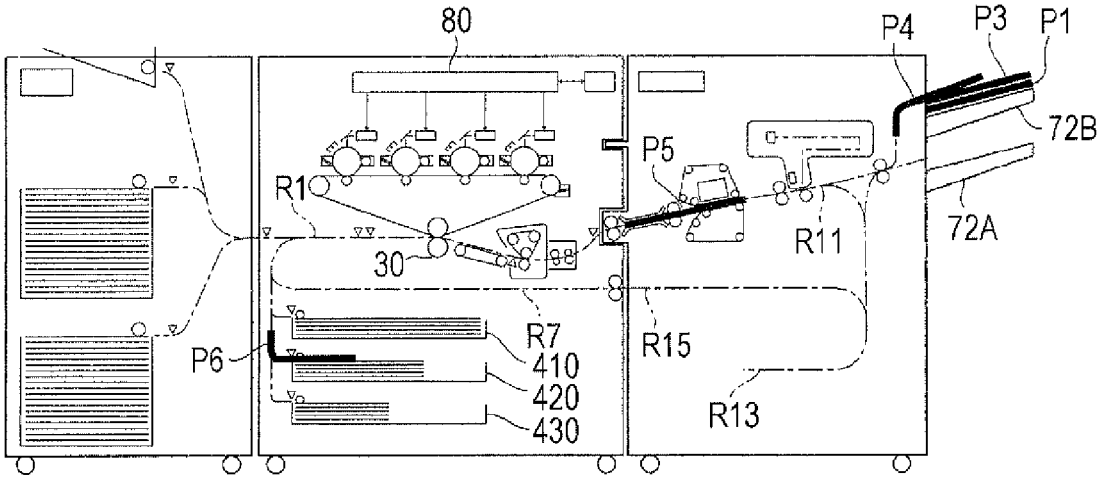

Upon completion of the up-purging process, additional feeding is performed. In this example, the number of passing sheets in the up-purging process is three, namely, the sheets P3 to P5, and the reference number of sheets is four. Therefore, a single sheet P, which is equivalent to the difference between the number of passing sheets and the reference number of sheets, is additionally fed. In detail, as shown in FIG. 9E, a sheet P6 is additionally fed from the second sheet feed device 420. The fixing device 50 is additionally cleaned by this sheet P6.

As described above, in this exemplary embodiment, the number of sheets P passing through the fixing device 50 during the up-purging process is counted, and the number of additionally-fed sheets is equivalent to the difference between the number of passing sheets and the reference number of sheets. Consequently, for example, when the operator removes the fixation sheet and the source sheet, even if the operator mistakenly removes a sheet other than the fixation sheet and the source sheet, that is, a sheet P that is to be removed, a sheet or sheets P to be used for cleaning the fixing device 50 is/are sufficiently fed to the fixing device 50. Therefore, the fixing device 50 is reliably cleaned while the number of additionally-fed sheets is minimized.

By minimizing the number of additionally-fed sheets, the cost of the sheets P and the cost charged for the image forming operation by the image forming system 100 may be reduced.

Furthermore, in this exemplary embodiment described above, if a jam occurs during the up-purging process, the system undergoes emergency stoppage and additional feeding is not performed. Consequently, the number of additionally-fed sheets is minimized.

As described above, the integrated controller 80 makes the UI 90 display the image 903 indicating the position of a sheet P to be removed by the operator in the image forming system 100. Consequently, a sheet P other than the sheet P to be removed, that is, a remaining sheet to be used in the up-purging process, may be prevented from being mistakenly removed by the operator. Thus, the number of remaining sheets used for the up-purging process, that is, the number of passing sheets, is ensured, thereby minimizing the number of additionally-fed sheets.

As described above, the up-purging process and the additional feeding are successively performed while the fixing device 50 is maintained at the fixation temperature. With the fixing device 50 maintained at the fixation temperature, the cleaning effect for the fixing device 50 may be improved.

Furthermore, by performing the up-purging process and the additional feeding without lowering the fixation temperature of the fixing device 50, the time it takes to increase the temperature of the fixing device 50 is reduced, thereby shortening the time of the recovery operation.

Modifications

Figure 10A:
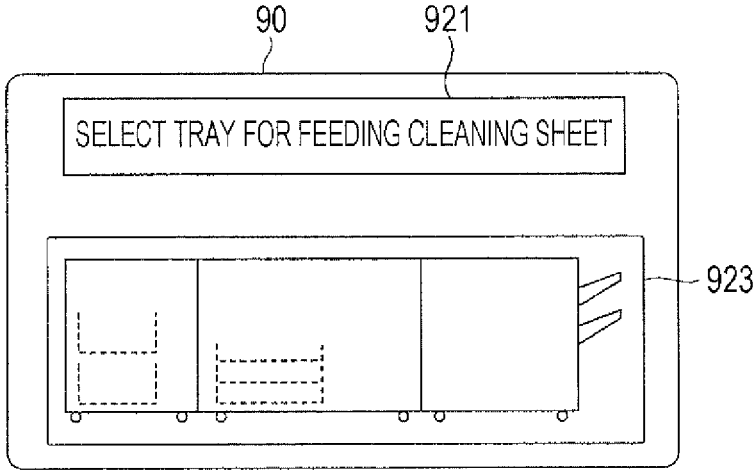
FIG. 10A illustrates a modification in which a sheet feed device that feeds an additionally-fed sheet or sheets is selectable.
Figure 10B:
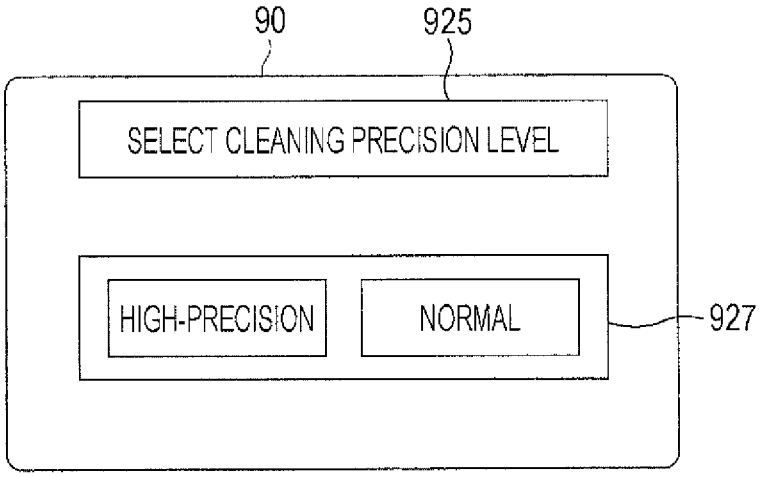
FIG. 10B illustrates a modification in which a cleaning precision level is selectable.

Next, modifications will be described with reference to FIGS. 10A and 10B. FIG. 10A illustrates a modification in which a sheet feed device that feeds an additionally-fed sheet or sheets is selectable. FIG. 10B illustrates a modification in which a cleaning precision level is selectable.

The integrated controller 80 may include a feed-device selection receiving unit (not shown) that receives a designation (i.e., a selection) of a sheet feed device (i.e., one of the first sheet feed device 410 to the sixth sheet feed device 460) that feeds an additionally-fed sheet or sheets. As shown in FIG. 10A, prior to performing additional feeding, the integrated controller 80 makes the UI 90 display an image 921 prompting the operator to select a sheet feed device that feeds an additionally-fed sheet or sheets and an image 923 indicating the positions of sheet feed devices that feed additionally-fed sheets in the image forming system 100. Based on the image 921 and the image 923, the operator may select a sheet feed device that carries sheets P that satisfy the operator's requests, such as the unit price of the sheets P and the type of sheets P. For example, inexpensive sheets P dedicated to additionally feeding may be loaded in any one of the first sheet feed device 410 to the sixth sheet feed device 460. By performing additional feeding from the sheet feed device that carries these inexpensive sheets P, the cost of sheets P used for the additional feeding may be minimized.

Furthermore, the integrated controller 80 may include a precision-level designation receiving unit (not shown) that receives a designation of a cleaning precision level. As shown in FIG. 10B, prior to fixation-sheet processing, the integrated controller 80 makes the UI 90 display an image 925 prompting the operator to select a cleaning precision level and an image 927 used for selecting a cleaning precision level. Based on the image 925 and the image 927, the operator may select a cleaning precision level. The reference number of sheets in a case where high precision is designated as a cleaning precision level is set to be larger than the reference number of sheets for normal precision. Thus, the number of additionally-fed sheets when high precision is designated becomes larger than that when normal precision is designated, thereby increasing the cleaning precision level when high precision is designated. In this modification, the mode is switchable between the high-precision mode for prioritizing the cleaning precision level and the normal-precision mode for prioritizing cost.

In the above description, a sheet P located downstream of the source sheet is discharged by down-purging. Alternatively, a sheet P located downstream of the fixing device 50 and downstream of the source sheet may be discharged by down-purging.

Furthermore, in the above description, it is determined whether to perform fixation-sheet processing based on whether or not a sheet P is stopped at the fixing device 50. In this case, the expression "a sheet P is stopped at the fixing device 50" refers to that the sheet P is stopped such that the unfixed toner adhered to this sheet P may contaminate the fixing device 50 when the stopped sheet P is removed. Therefore, the expression "a sheet P is stopped at the fixing device 50" may also refer to that, for example, the sheet P is stopped in a range extending from the nip N of the fixing device 50 to a predetermined distance therefrom toward upstream in the sheet transport direction. Moreover, the expression "a sheet P is stopped at the fixing device 50" may also refer to that the sheet P is stopped in the sheet transport path between the second-transfer device 30 and the nip N of the fixing device 50.

Although it is determined whether to perform fixation-sheet processing based on whether or not a sheet P is stopped at the fixing device 50 in the above description, the configuration is not limited thereto. Regardless of whether or not a sheet P is stopped at the fixing device 50, the aforementioned fixation-sheet processing may be executed every time the sheet transport operation is stopped due to the occurrence of a jam.

Furthermore, in the above description, the counting unit 805 of the integrated controller 80 is configured to count the number of sheets P. Alternatively, the length, in the transport direction, of sheets P transported to the fixing device 50 may be measured every time a sheet P passes therethrough, and an accumulative value (i.e., accumulative sheet length) thereof may be counted, so long as the number of sheets P transported to the fixing device 50 is countable.

Furthermore, in the above description, the number of sheets P is counted via the passing sensor PS of the position adjuster 60. Alternatively, the number of sheets P may be counted via another passing sensor PS or another detector.

Although the reference number of sheets is set to four as an example in the above description, the reference number of sheets may be set to a sufficient value for reliably cleaning the fixing device 50 and may be set to a value ranging between, for example, 1 and 20. With regard to this reference number of sheets, multiple numerical values may be stored in the storage unit 807 of the integrated controller 80 in accordance with, for example, the size of sheets P onto which images are to be formed, the type of sheets P, and the amount of toner used for forming images onto the sheets P, such that the reference number of sheets suitable for the conditions of an executed job may be used.

In the above description, the up-purging process is determined as being completed based on whether or not the duration of the up-purging process has exceeded a predetermined time. Alternatively, the up-purging process may be determined as being completed, for example, when it is detected that the last one of sheets P transported in the up-purging process has reached the second-transfer device 30 or that the last one of sheets P transported in the up-purging process has been loaded onto the second sheet load section 72B, based on a signal from the corresponding passing sensor PS.

Furthermore, in a case where an openable-closable cover member (not shown) provided in the image forming system 100 is opened or closed during the up-purging process or when additional feeding is to be performed, the system may be configured to undergo emergency stoppage and not to perform additional feeding.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising;

a feed section that feeds a sheet;

a transport section that transports the sheet fed from the feed section;

a toner-image forming section that forms a toner image onto the sheet transported by the transport section;

a fixing section that fixes the toner image formed by the toner-image forming section onto the sheet;

a problem detecting section that detects a problem in a sheet transport operation; and an additional feed section that feeds an additional sheet from the feed section toward the fixing section if a number of sheets stopped by the transport section in accordance with detection of the problem by the problem detecting section and subsequently transported toward the fixing section after the sheet transport operation is resumed is smaller than a predetermined number.

2. The image forming system according to claim 1, further comprising:

a fixation-sheet detecting section that detects a sheet stopped at the fixing section when the transport section stops the sheet transport operation in accordance with the detection of the problem by the problem detecting section, wherein the additional feed section does not feed the additional sheet from the feed section if the fixation-sheet detecting section does not detect a sheet.

3. The image forming system according to claim 1, wherein the additional feed section includes a counting unit that counts the number of or an accumulative sheet length, in a sheet transport direction, of sheets stopped by the transport section in accordance with the detection of the problem by the problem detecting section and subsequently transported toward the fixing section after the sheet transport operation is resumed, and an output unit that outputs a command for feeding the additional sheet from the feed section toward the fixing section based on a difference between the predetermined number and a counted value obtained by the counting unit if the counted value is smaller than the predetermined number.

4. The image forming system according to claim 1, wherein the fixing section is maintained at a fixation temperature, which is a temperature for fixing the toner image onto the sheet, until the feeding of the additional sheet by the additional feed section is completed after the sheet transport operation by the transport section is resumed.

5. The image forming system according to claim 1, wherein the toner-image forming section does not form a toner image onto the additional sheet fed from the feed section toward the fixing section by the additional feed section.

6. An image forming apparatus comprising:

a transport section that transports a fed sheet;

a toner-image forming section that forms a toner image onto the sheet transported by the transport section;

a fixing section that fixes the toner image formed by the toner-image forming section onto the sheet;

a problem detecting section that detects a problem in sheet transport operation; and an additional feed section that feeds additional sheets from the feed section toward the fixing section if a number of sheets stopped by the transport section in accordance with detection of the problem by the problem detecting section and subsequently transported toward the fixing section after the sheet transport operation is resumed is smaller than a predetermined number, a number of additional sheets fed by the additional feed section corresponding to a difference between the predetermined number and the number of transported sheets.

7. An image forming method comprising:

feeding a sheet;

transporting the fed sheet;

forming a toner image onto the transported sheet;

fixing the formed toner image onto the sheet;

detecting a problem in a sheet transport operation; and feeding an additional sheet if a number of sheets stopped in accordance with detection of the problem and subsequently transported after the sheet transport operation is resumed is smaller than a predetermined number.

* * * * *